US006797929B2

(12) United States Patent
Drozd et al.

(10) Patent No.: US 6,797,929 B2
(45) Date of Patent: Sep. 28, 2004

(54) CYLINDRICAL REACTOR WITH AN EXTENDED FOCAL REGION

(75) Inventors: J. Michael Drozd, Raleigh, NC (US); William T. Joines, Durham, NC (US)

(73) Assignee: Industrial Microwave Systems, L.L.C., Morrisville, NC (US)

( * ) Notice: Subject to any disclaimer, the term of this patent is extended or adjusted under 35 U.S.C. 154(b) by 0 days.

(21) Appl. No.: 10/149,015

(22) PCT Filed: Dec. 7, 2000

(86) PCT No.: PCT/US00/33080

§ 371 (c)(1),
(2), (4) Date: Dec. 16, 2002

(87) PCT Pub. No.: WO01/43508

PCT Pub. Date: Jun. 14, 2001

(65) Prior Publication Data

US 2003/0205576 A1 Nov. 6, 2003

Related U.S. Application Data

(60) Provisional application No. 60/169,300, filed on Dec. 7, 1999.

(51) Int. Cl.[7] ..... H05B 6/72; H05B 6/78

(52) U.S. Cl. ..... 219/696; 219/697; 219/748; 219/750; 219/738; 333/231; 34/264

(58) Field of Search ..... 219/748, 746, 219/745, 750, 690, 695, 696, 697, 756, 738, 736, 693, 699, 749, 751; 333/230, 233, 227, 231, 232; 34/259, 264

(56) References Cited

U.S. PATENT DOCUMENTS

| | | | | |
|---|---|---|---|---|
| 2,827,537 A | | 3/1958 | Haagensen | |
| 2,909,635 A | * | 10/1959 | Haagensen | 219/746 |
| 3,102,181 A | * | 8/1963 | Verstraten | 219/693 |
| 3,430,021 A | | 2/1969 | Watson | |
| 3,461,261 A | | 8/1969 | Lewis et al. | |
| 3,564,458 A | | 2/1971 | Cumming | |
| 3,710,064 A | * | 1/1973 | Mathur | 219/692 |
| 3,783,221 A | | 1/1974 | Soulier | |
| 3,789,179 A | | 1/1974 | Haagensen | |
| 3,873,934 A | | 3/1975 | Oltman, Jr. et al. | |
| 4,237,145 A | | 12/1980 | Risman et al. | |
| 4,760,230 A | | 7/1988 | Hässler | |
| 5,796,080 A | * | 8/1998 | Jennings et al. | 219/697 |
| 5,834,744 A | | 11/1998 | Risman | |
| 5,998,774 A | | 12/1999 | Joines et al. | |
| 6,020,580 A | | 2/2000 | Lewis et al. | |
| 6,104,018 A | * | 8/2000 | Varma et al. | 219/746 |
| 6,121,595 A | | 9/2000 | Lewis et al. | |

FOREIGN PATENT DOCUMENTS

| | | | | |
|---|---|---|---|---|
| JP | 64-30194 | * | 2/1989 | 219/697 |
| JP | 2-265149 | | 10/1990 | |
| WO | WO 98/34435 | | 8/1998 | |

* cited by examiner

*Primary Examiner*—Philip H. Leung

(57) ABSTRACT

An elliptical exposure chamber has an extended focal region. A plurality of cylindrical reactors (25) form the extended focal region. Reducing the size of the opening (58) to each reactor (25) reduces the amount of energy reflected and increases the overall heating. In order to efficiently deliver the electromagnetic energy to the reduced opening (58), a tapered waveguide (55) has a concave end (56). A power splitter (42) divides power from a central waveguide (52) to the plurality of reactors (25). The power that is delivered to each reactor (25) can be adjusted by adjusting the impedance of each reactor (25), the width of each reactor (25) or the width of the opening (58) to each reactor (25). The width of the opening (58) to each reactor (25) can be controlled by a movable metal plate (44). A dielectric wheel can be used to shift hot spots along the focal region.

20 Claims, 5 Drawing Sheets

CYLINDRICAL REACTOR WITH AN EXTENDED FOCAL REGION

The present application is filed pursuant to 35 U.S.C. §371, and was filed as International Application No. PCT/US00/33080 on Dec. 7, 2000, which in turn claimed priority to provisional U.S. Patent Application Ser. No. 60/169,300 filed on Dec. 7, 1999. Applicants hereby claim all available rights to priority based on the above, including those rights as prescribed by 35 U.S.C. §119, §363, and/or §365.

FIELD OF INVENTION

This invention relates to electromagnetic energy, and more particularly, to providing more efficient electromagnetic exposure.

BACKGROUND

U.S. Pat. No. 5,998,774, which is incorporated by reference in its entirety, describes an invention for creating uniformity over a cylindrical region, herein referred to as the standard cylindrical reactor. Unfortunately, the exposure width of this invention for maintaining true uniformity is limited by the maximum waveguide width for keeping the electromagnetic wave in $TE_{10}$ mode. Limited width has a disadvantage in exposing materials that require a longer exposure time to microwave energy. Similarly, some materials are not able to withstand a high power density, and a wider exposure region would lead to a lower power density.

SUMMARY

An elliptical exposure chamber has an extended focal region. In an exemplary embodiment, a plurality of cylindrical reactors form the extended focal region. Reducing the size of the opening to each cylindrical reactor reduces the amount of energy reflected and increases the overall heating. In order to efficiently deliver the electromagnetic energy to the reduced opening, a tapered waveguide has a concave end. A power splitter divides power from a central waveguide to the plurality of cylindrical reactors. The power that is delivered to each cylindrical reactor can be adjusted by adjusting the impedance of each reactor (i.e. increasing or decreasing the impedance matching), adjusting the width of each reactor, or adjusting the width of the opening to each reactor. The width of the opening to each reactor can be controlled by, for example, a movable metal plate. A dielectric wheel can be used to shift hot spots along the focal region.

BRIEF DESCRIPTION OF THE DRAWINGS

The foregoing, and other objects, features, and advantages of the invention will be more readily understood upon reading the following detailed description in conjunction with the drawings in which.

DETAILED DESCRIPTION

In the following description, specific details are discussed in order to provide a better understanding of the invention.

However, it will be apparent to those skilled in the art that the invention can be practiced in other embodiments that depart from these specific details. In other instances, detailed descriptions of well-known methods and circuits are omitted so as to not obscure the description of the invention with unnecessary detail.

The present invention extends the useful width of the cylindrical reactor to virtually any width. There are two basic embodiments of the invention. The first embodiment cascades multiple cylindrical reactors together, herein referred to as the cascaded cylindrical reactor. The second embodiment simply widens the exposure region for a standard cylindrical reactor, herein referred to as the extended cylindrical reactor.

Figure 1:
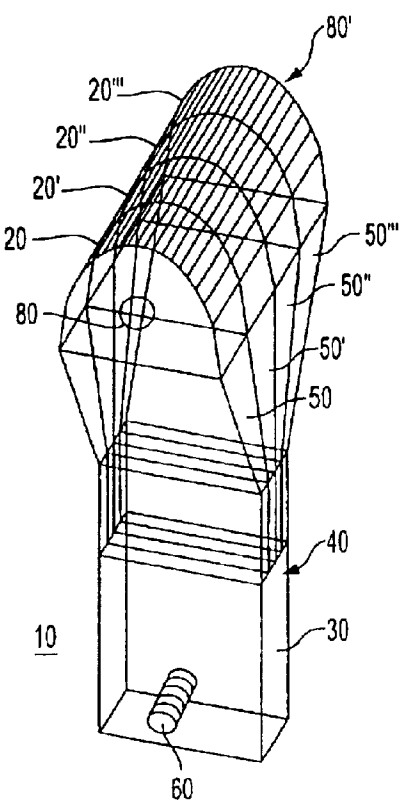
FIG. 1 illustrates a cascaded cylindrical reactor.

FIG. 1 illustrates a cascaded cylindrical reactor. In the cascaded cylindrical reactor 10, the series of cylindrical reactors 20 are in direct contact or in close proximity. Power into the series of cylindrical reactors can be provided by a single waveguide 30. Using a power splitter 40, energy can be split into multiple waveguides 50 and then into each individual cylindrical reactor 20. The power splitter 40 could be as simple as placing septums into the single waveguide 30 parallel to the broad wall of waveguide 30. Using these power splitters 40 may require impedance matching 60 to insure maximum transfer of power to each individual reactor 20.

Figure 2:
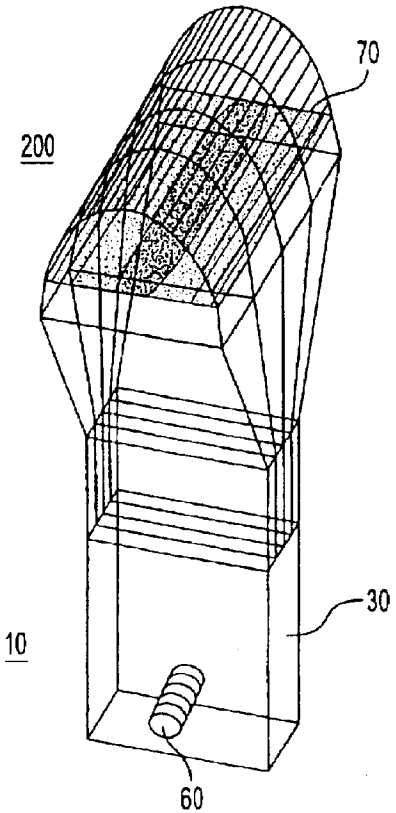
FIGS. 2 and 3 illustrate field intensity in a cascaded cylindrical reactor.
Figure 4:
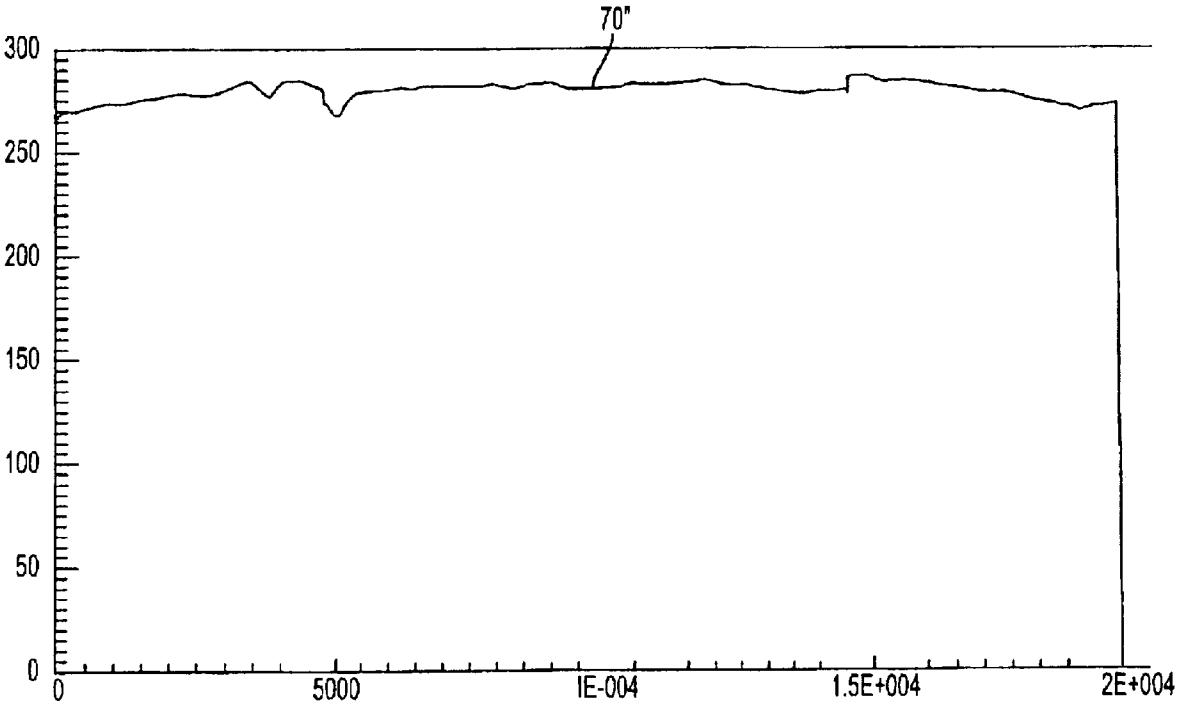
FIG. 4 illustrates field intensity across the focal region.
Figure 3:
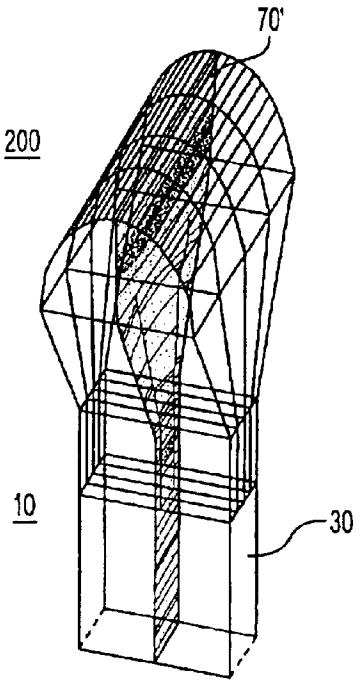

FIGS. 2 and 3 illustrate the field distribution 70 in chamber 200. It is important to note the degree of uniformity over a wide width. FIG. 4 is the field intensity 70' across the focal region of chamber 200.

With the cascaded cylindrical reactor 10, it is possible to create a system in which each individual cylindrical reactor 20 has a different field intensity. Varying the field intensity between each individual cylindrical reactor 20 allows a material to be exposed to different levels of microwave energy 70 as it passes through the system, and more specifically, opening 80. This can be accomplished in a number of ways. First, a tuning stub 60 can be placed in each individual septum. These tuning stubs 60 affect the impedance of each individual reactor 20 and thus the amount of energy that propagates in each cylindrical reactor 20. Another way of affecting the amount of microwave energy in each cavity 20 is by changing the distances between each septum in the power splitter. One advantage of changing the field intensity between each cylindrical reactor 20 is that a predefined temperature distribution over time can be achieved throughout the process. For example, it may be desirable to initially have a slow ramp in temperature and end with a very high ramp in temperature.

As a final note on the cascaded cylindrical reactor 10, there is practical limit on splitting a single waveguide 30. To extend the width beyond this limit, each septum of the first waveguide can be formed into a waveguide that can then be split into more waveguides. This may require impedance matching 60 at each power splitter.

Figure 5:
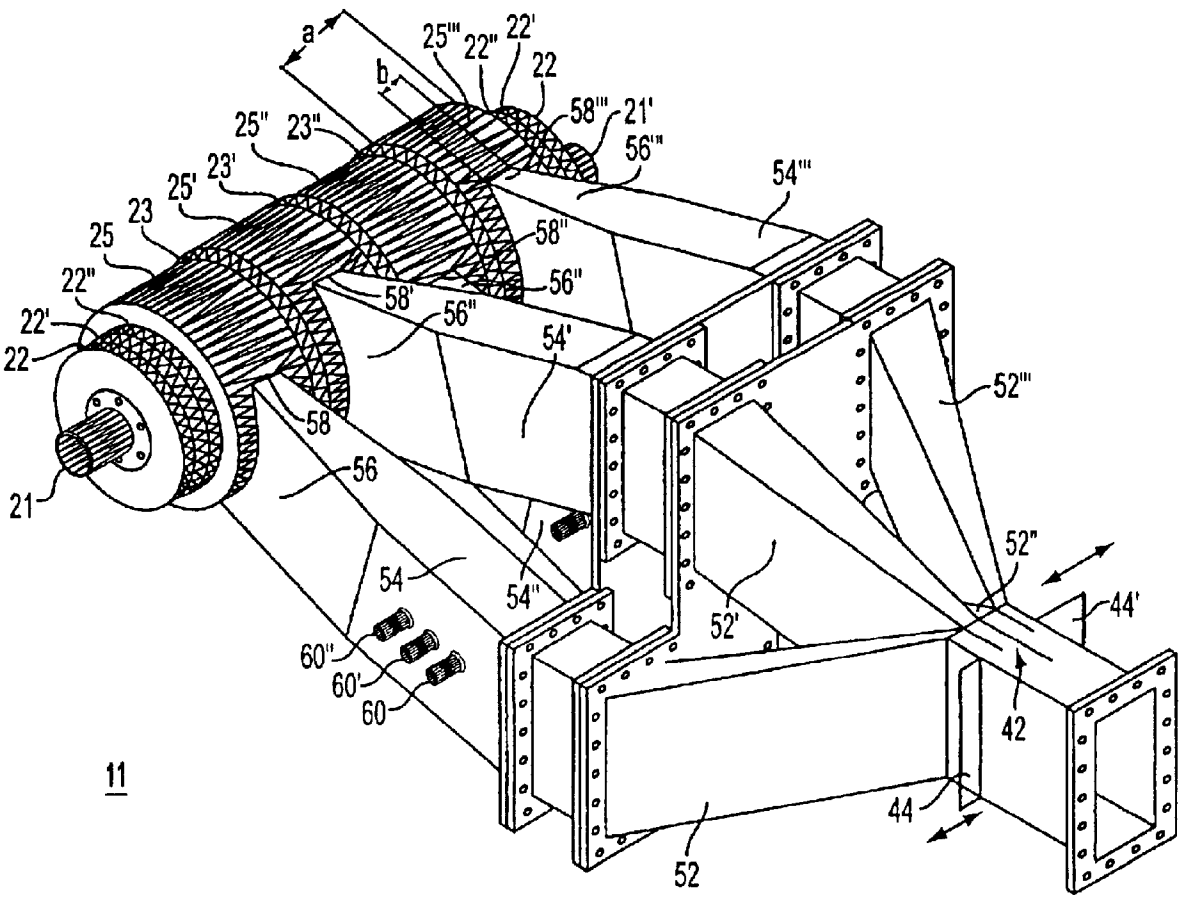
FIG. 5 illustrates an improved cascaded cylindrical reactor.

FIG. 5 illustrates an improved cascaded cylindrical reactor 11. In the improved reactor 11, the cylindrical reactors 25 are preferably separated by choke flanges 23. The spacing of the cylindrical reactors 25 (i.e. the width of choke flange 23) can be increased or decreased to control the amount of cooling between each reactor 25. Using a power splitter 42, energy can be split into multiple secondary waveguides 52. Or alternatively, each waveguide 52 can be powered by a separate source. The power delivered to each reactor 25 can be controlled by a movable metal plate 44 and/or increasing or decreasing the impedance matching 60. It will be appreciated by those skilled in the art that as a solid melts the dielectric values change. As a solid, the material may absorb less energy. As a liquid, the material may absorb more energy. Accordingly, it may be advantageous to increase power to initial reactor 25 and decrease power to subsequent reactors 25'.

According to the improved design, the multiple waveguides 52 are spaced so that each waveguide 52 is easily accessible. This can be achieved by projecting waveguide 52' upwardly and an adjacent waveguide 52" downwardly. In addition, each cylindrical reactor 25 comprises a circular shape that has a reduced opening 58. If, for example, reactor 25 has a width of a, opening 58 has a width of b, where b is less than a. Reducing the size of opening 58 reduces the amount of energy reflected and increases the overall heating. In order to efficiently deliver the electromagnetic energy to reduced opening 58, tertiary waveguide 54 is connected to a tapered region 55. Tapered region 55 comprises a concave end 56, where concave end 56 engages a convex exterior surface of reactor 25. Electromagnetic energy is contained within reactor 25 by three circular choke flanges 22 and an outwardly extending choke 21. The distance between the outside edge of choke flange 22 and the outside edge of choke 21 is equal to a quarter of a wave length of the electromagnetic wave in reactor 25.

Figure 6:
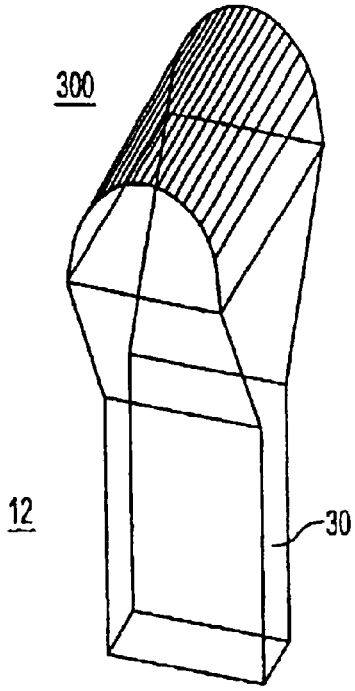
FIG. 6 illustrates an extended cylindrical reactor.

FIG. 6 illustrates an extended cylindrical reactor 12. The extended cylindrical reactor design 12 is similar to the standard cylindrical reactor 10 except that the exposure width 300 has been extended. The height of the exposure region 300 is not altered nor is the distance to the focal region.

The effect of simply widening the exposure region 300 is that modes beyond $TE_{10}$ are generated. However, if the height is not changed from the standard cylindrical reactor, then the only modes that are created are across the exposure width. As a result, a cylindrical field pattern 71 is maintained at every cross section, but hot and cold spots appear along the exposure region.

Figure 7:
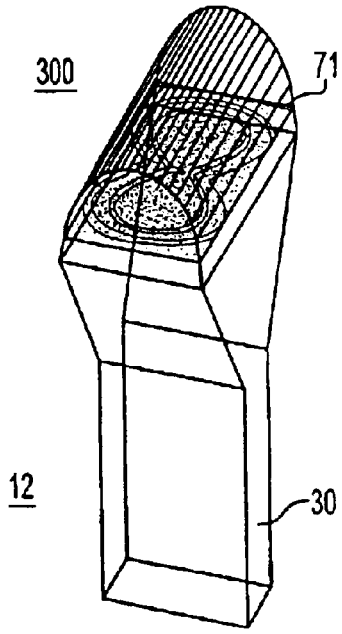
FIGS. 7 and 8 illustrate field distribution in an extended cylindrical reactor.
Figure 8:
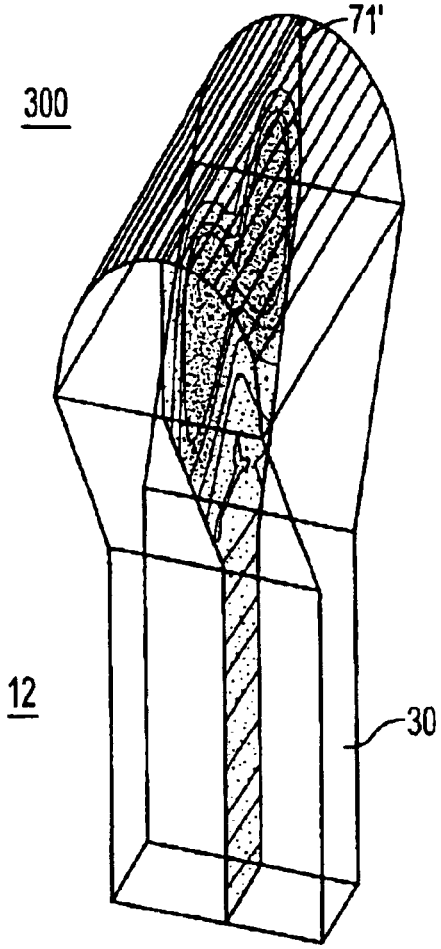

FIGS. 7 and 8 illustrate the field pattern 71 in an extended cylindrical reactor 12. For some applications, hot spots are not tolerable. However, for most continuous flow applications, systematic hot spots would not present a problem. In fact in some instances exposing some materials to alternating hot and cold spots may have advantages. It should also be noted that it is possible to cause the hot spot pattern to dynamically shift. One way to accomplish this would be to introduce a rotating dielectric. This would continually change the effective width of the exposure width and thus dynamically shift the hot spots. The net result would be a more uniform exposure of the material.

While the foregoing description makes reference to particular illustrative embodiments, these examples should not be construed as limitations. Thus, the present invention is not limited to the disclosed embodiments, but is to be accorded the widest scope consistent with the claims below.

What is claimed is:

1. A device comprising:

a plurality of cylindrical reactors including openings thereinto arranged to allow a material to pass sequentially through the plurality of cylindrical reactors;

an electromagnetic energy source;

a first waveguide in communication with the energy source;

a splitter in communication with the first waveguide, such that electromagnetic energy is transferred into each of the plurality of cylindrical reactors to expose the material to electromagnetic energy.

2. The device as described in claim 1, wherein the power splitter divides power from a central waveguide to each of the plurality of cylindrical reactors.

3. The device as described in claim 2, the device further comprising a second power splitter, the second power splitter dividing power from a second central waveguide to the first central waveguide.

4. The device as described in claim 2, the device further comprises a tuning stub for matching the impedance of the power splitter.

5. The device as described in claim 4, wherein an impedance is adjusted to vary an amount of energy delivered to a cylindrical reactor.

6. The device as described in claim 2, wherein the power splitter is connected to a plurality of secondary waveguides, a first secondary waveguide projecting upwardly, a second secondary waveguide projecting downwardly.

7. The device as described in claim 1, the device further comprising septums parallel to a broad wall of a central waveguide, the septums dividing power from the central waveguide to the plurality of cylindrical reactors.

8. The device as described in claim 7, wherein a septum width is adjusted to vary an amount of energy delivered to a cylindrical reactor.

9. The device as described in claim 1, further comprising a movable metal plate positioned to control the amount of power delivered to at least one of the cylindrical reactors.

10. The device as described in claim 1, wherein two cylindrical reactors are separated by a choke flange.

11. The device as described in claim 1, wherein at least one of the cylindrical reactors comprises a cylinder region with a width equal to a and an electromagnetic waveguide connected to the cylinder region, the electromagnetic waveguide forming an opening to the cylinder region, the width of the opening equal to b, where b is less than a.

12. The device as described in claim 11, wherein the electromagnetic waveguide is a tapered waveguide.

13. The device as described in claim 11, the electromagnetic waveguide comprising a concave end.

14. The device as described in claim 13, wherein the electromagnetic waveguide is a tapered waveguide.

15. The device as described in claim 1, wherein the plurality of cylindrical reactors are in series.

16. The device as described in claim 15, wherein the plurality of cylindrical reactors are in direct contact.

17. The device as described in claim 15, wherein the plurality of cylindrical reactors are in close proximity to each other.

18. The device as described in claim 1, wherein each of the cylindrical reactors has a different field intensity.

19. A device for exposing materials to an electromagnetic field, the device comprising an elliptical exposure chamber through which materials to be exposed to the electromagnetic field travel, the exposure chamber defining a focal region within the chamber and a width along the direction in which materials being exposed travel, the focal region having a width sufficient to produce a cylindrical electromagnetic field pattern of both hot and cold spots along the width of the focal region.

20. The device of claim 19, further comprising a rotating dielectric adapted to dynamically shift the pattern of hot and cold spots.

* * * * *